United States Patent [19]

Adachi

[11] 4,442,380

[45] Apr. 10, 1984

[54] DISCHARGE TUBE FIRING DEVICE

[75] Inventor: Hiromi Adachi, Kamakura, Japan

[73] Assignee: Mitsubishi Denki Kabushiki Kaisha, Tokyo, Japan

[21] Appl. No.: 297,169

[22] Filed: Aug. 28, 1981

[30] Foreign Application Priority Data

Sep. 11, 1980 [JP] Japan ..... 55-126597

[51] Int. Cl.[3] ..... H05B 39/00; H05B 37/00

[52] U.S. Cl. ..... 315/101; 315/207; 315/241 R; 315/244; 315/290

[58] Field of Search ..... 315/99, 101, 207, 224, 315/243, 289, 227, 241 R, 244, 290

[56] References Cited

U.S. PATENT DOCUMENTS

| | | | |
|---|---|---|---|
| 3,878,429 | 4/1975 | Iwata | 315/241 R |
| 4,165,475 | 8/1979 | Pegg et al. | 315/101 |
| 4,275,335 | 6/1981 | Ishida | 315/207 |
| 4,347,462 | 8/1982 | Adachi | 315/101 |
| 4,360,762 | 11/1982 | Yamamoto | 315/101 |

FOREIGN PATENT DOCUMENTS

| | | |
|---|---|---|
| 48-19181 | 6/1973 | Japan . |
| 48-28726 | 9/1973 | Japan . |
| 50-20579 | 3/1975 | Japan . |
| 50-59182 | 12/1975 | Japan . |
| 54-128378 | 9/1979 | Japan . |

*Primary Examiner*—Harold Dixon

*Attorney, Agent, or Firm*—Wenderoth, Lind & Ponack

[57] ABSTRACT

The disclosed firing device comprises a fluorescent lamp serially connected to an inductive stabilizer, a first semiconductor switch including an SCR connected across the fluorescent lamp, and a nonlinear dielectric element serially connected to a parallel combination of a PNPN switch as a second semiconductor switch and a discharging circuit across the fluorescent lamp. The discharging circuit may comprise a resistor alone. The first semiconductor switch may include a semiconductor diode and a PNPN switch and the discharging circuit may include a resistor connected across series combination of a semiconductor diode. Alternatively, the discharging circuit may include a Zener diode and a resistor serially interconnected.

6 Claims, 18 Drawing Figures

FIG. 1.
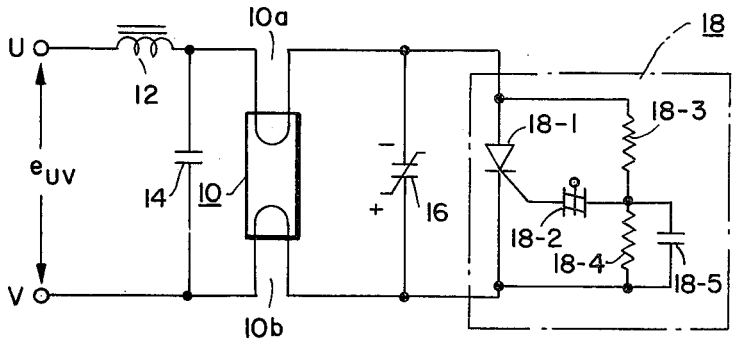
FIG. 2a.
FIG. 2b.
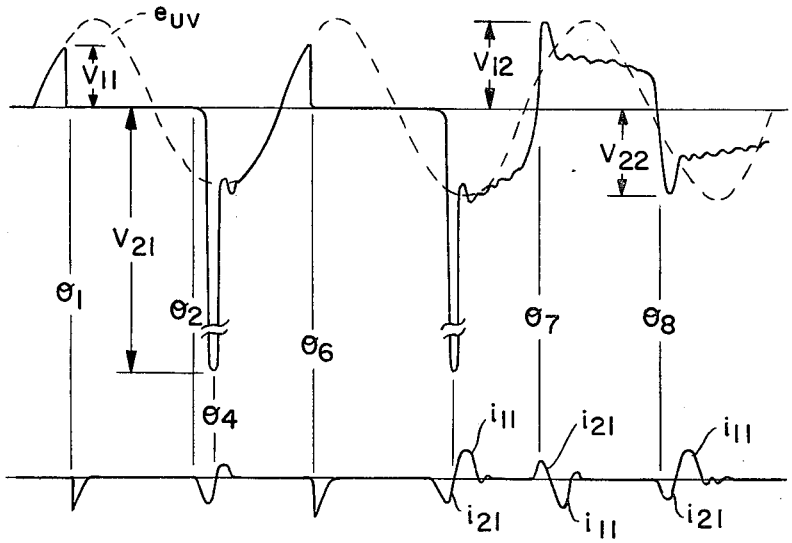
FIG. 3.
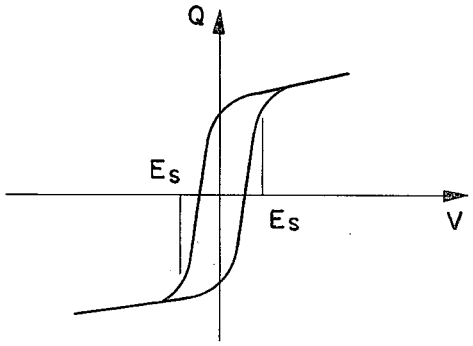

FIG. 6.
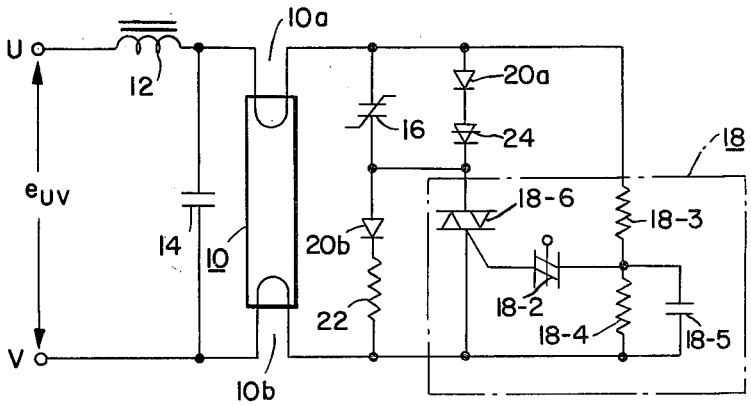
FIG. 7a.
FIG. 7b.
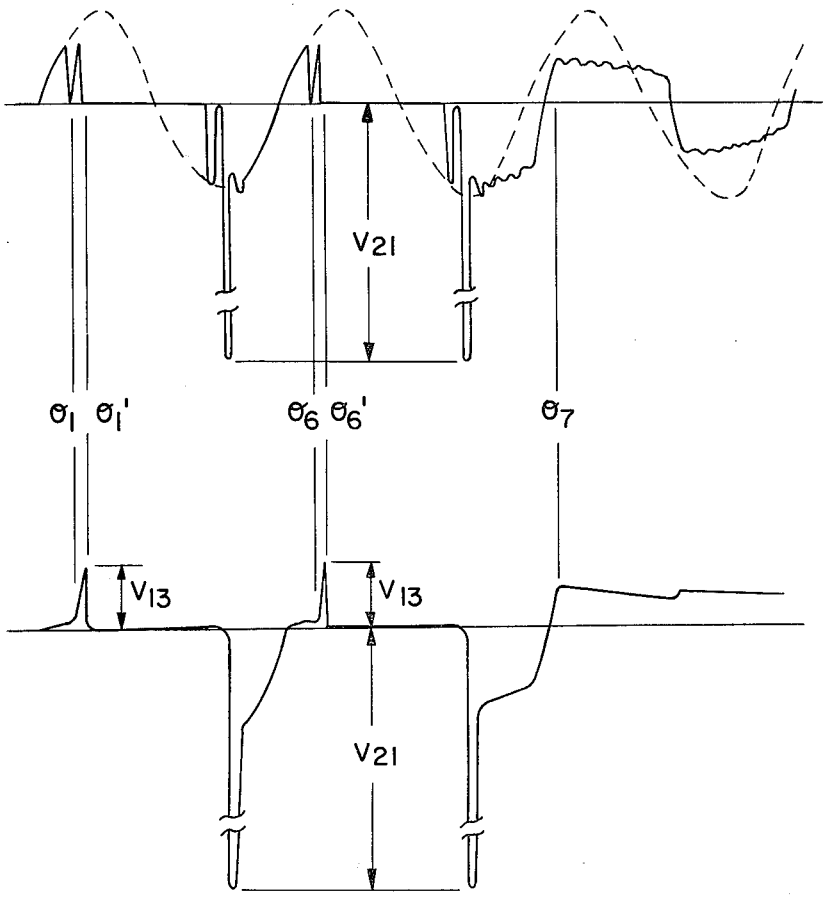

FIG. 8.
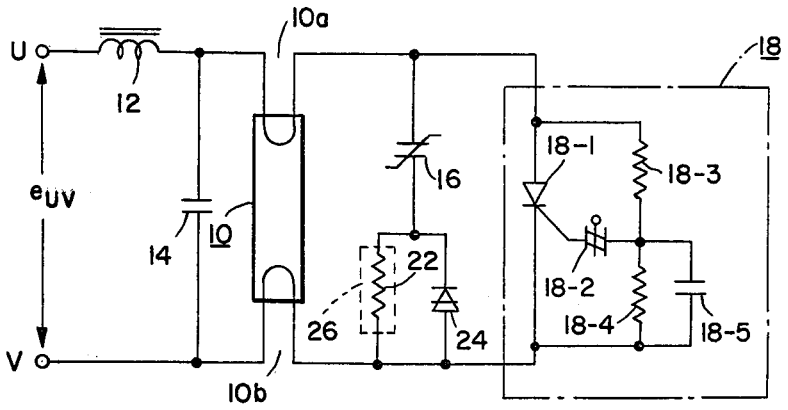
FIG. 9a.
FIG. 9b.
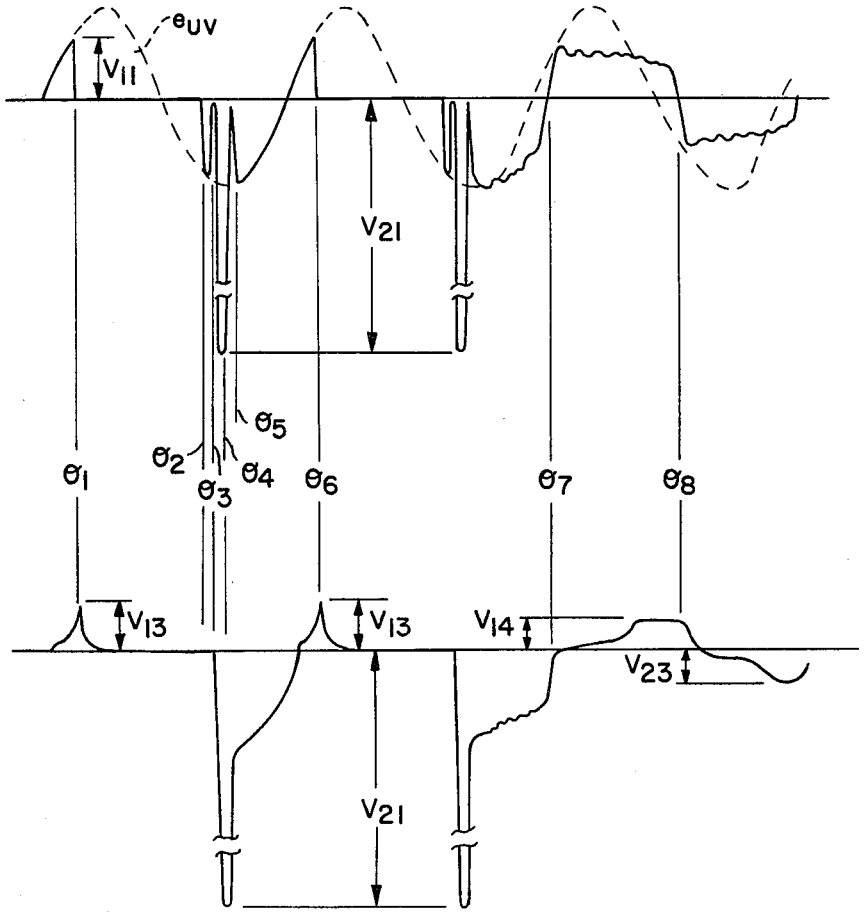

DISCHARGE TUBE FIRING DEVICE

BACKGROUND OF THE INVENTION

This invention relates to improvements in a discharge tube firing device using a semiconductor switch as a starter for a discharge tube such as a fluorescent lamp.

There have been already proposed various starters using the semiconductor element for starting the discharge tube, for example, the fluorescent lamp connected across an associated AC source through an inductive stabilizer. One known starter of the type referred to has comprised a nonlinear dielectric element and a reverse blocking triode thyristor each connected across the fluorescent lamp. The thyristor is turned on in a positive half cycle of a source voltage to permit the fluorescent lamp to be pre-heated and off in the next negative half cycle thereof adjacent at the negative peak source voltage. At that time the nonlinear dielectric element is charged with a negative pulsed high voltage due to the inductive stabilizer. The pulsed high voltage is also applied across the fluorescent lamp. The process as described above is repeated until the fluorescent lamp is fired.

The starter as described above is advantageous in that it is cheap and good in starting characteristics but disadvantageous in that, when the fluorescent lamp is re-fired to suddenly increase in voltage thereacross, a charging current from an associated electric source flows into the nonlinear dielectric element and that, after an electric discharge across the fluorescent lamp, a discharging current from that element flows into the fluorescent lamp to increase an electric power consumed by the fluorescent lamp. The charging and discharging currents have caused an electrostrictive vibration of the nonlinear dielectric element and therefore vibrational noise.

In order to eliminate those disadvantages, it has been previously proposed to connect a bidirectional triode thyristor substituted for the reverse blocking triode thyristor, in series to a semiconductor diode across the fluorescent lamp and further connect the nonlinear dielectric element across the semiconductor diode and also in series to a discharging circuit across the fluorescent lamp. The discharging circuit includes a semiconductor diode and a resistor connected in series to each other. The discharging current flows through the discharging network but not through the fluorescent lamp. After the fluorescent lamp has electrically discharged, a voltage thereacross is applied to the bidirectional triode thyristor through the diode and the nonlinear dielectric element has a substantially null voltage applied thereacross resulting in the elimination of vibrational noise.

However the semiconductor diode is connected across the nonlinear dielectric element to prevent a positive voltage from being applied across the latter resulting in the negative pulsed voltage much decreasing in amplitude. This means that it is difficult to start the fluorescent lamp.

Also there has been proposed to connect serially a diode thyristor to the semiconductor diode across the nonlinear dielectric element in order to avoid the disadvantage that the nonlinear dielectric element is not at all applied with the positive voltage. In this measure, a voltage approximating the source voltage is applied across the diode thyristor after the turn-on of the bidirectional triode thyristor and therefore across the nonlinear dielectric element. Thus a positive voltage can be applied across that element.

However when the diode thyristor is turned on with the voltage approximating the source voltage, the fluorescent lamp is initiated to be pre-heated resulting in the insufficient pre-heating of the fluorescent lamp. Therefore the fluorescent lamp has been difficult to be fired.

Accordingly it is an object of the present invention to provide a new and improved discharge tube firing device free from all the disadvantages of the prior art practice as described above.

SUMMARY OF THE INVENTION

The present invention provides a discharge tube firing device comprising a discharge tube, an inductive stabilizer connected in series to the discharge tube, a first semiconductor switch and a nonlinear dielectric element each connected in parallel to the discharge tube, a second semiconductor switch connected in series to the nonlinear dielectric element and in parallel to the first semiconductor switch, the second semiconductor switch serving as a charging circuit for the nonlinear dielectric element, and a discharging circuit connected in parallel to the second semiconductor switch.

Preferably the discharging circuit may be formed of a resistor.

Also the discharging circuit may be formed of a resistor, a semiconductor diode connected in series to the resistor and an impedance element connected in parallel to the series combination of the resistor and the semiconductor diode.

Further the discharging circuit may be formed of a resistor and a Zener diode connected in series to the resistor.

BRIEF DESCRIPTION OF THE DRAWINGS

The present invention will become more readily apparent from the following detailed description taken in conjunction with the accompanying drawings in which:

FIG. 1 is an electric circuit diagram of a conventional discharge tube firing device;

FIG. 2*a* is a graph illustrating a waveform of a voltage across the fluorescent lamp shown in FIG. 1;

FIG. 2*b* is a graph illustrating a waveform of a current through the nonlinear dielectric element shown in FIG. 1;

FIG. 3 is a graph illustrating a hysteresis curve for the relationship between a voltage across and an accumulated charge on the nonlinear dielectric element shown in FIG. 1;

FIG. 6 is a diagram similar to FIG. 1 but illustrating still another conventional discharge tube firing device;

FIGS. 7*a* and 7*b* are graphs similar to FIGS. 5*a* and 5*b* respectively but illustrating the arrangement shown in FIG. 6;

FIG. 8 is an electric circuit diagram of one embodiment according to the discharge tube firing device of the present invention;

FIG. 9*a* is a graph illustrating a waveform of a voltage across the fluorescent lamp shown in FIG. 8;

FIG. 9b is a graph illustrating a waveform of a voltage across the nonlinear dielectric element shown in FIG. 8;

Throughout the Figures like reference numerals and characters designate the identical or corresponding components.

DESCRIPTION OF THE PREFERRED EMBODIMENTS

Figure 4:
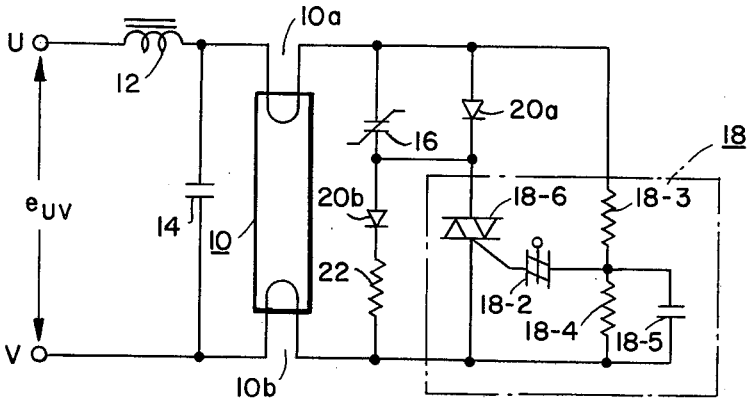
FIG. 4 is an electric circuit diagram of another conventional discharge tube firing device.

Referring now to FIG. 1 of the drawings, there is illustrated a conventional discharge tube firing device using a nonlinear dielectric element and a thyristor. The arrangement illustrated comprises a discharge tube, in this case, a fluorescent lamp generally designated by the reference numeral 10 including a filament 10a or 10b at each end thereof, an inductive stabilizer 12 connected across one end of the filament 10a and one source terminal U, and a noise preventing capacitor 14 connected across the one end of the filament 10a and a corresponding end of the filament 10b subsequently connected to the other source terminal V.

The filaments 10a and 10b include the other ends connected across a nonlinear dielectric element 16 (which is simply called hereinafter an "element") and also across a first semiconductor switch generally designated by the reference numeral 18. The semiconductor switch 18 includes a reverse blocking triode thyristor 18-1 connected across the element 16, a trigger element 18-2 such as an SBS (to which a silicon bilateral switch is abbreviated), diac or the like connected to a gate electrode of the reverse blocking triode thyristor 18-1, a voltage dividing gate network including a pair of resistors 18-3 and 18-4 serially interconnected across an anode and a cathode electrode of the thyristor 18-1 and a smoothing capacitor 18-5 connected across the resistor 18-4 with the trigger element 18-2 connected to the junction of the resistors 18-3 and 18-4.

When an AC source voltage $e_{uv}$ is applied across the source terminals u and v as shown at dotted waveform $e_{uv}$ in FIG. 2a, the thyristor 18-1 is turned on at a suitable phase $\theta_1$ of a positive half cycle of the source voltage (see FIG. 2a) at the beginning of the start, a current flows through a current path traced from the source terminal U through the inductive stabilizer 12, the filament 10a, the thyristor 18-1, the filament 10b and thence to the source terminal V to pre-heat the filaments 10a and 10b.

After the pre-heating current has flowed through the filaments 10a and 10b, the current through the thyristor 18-1 reaches it null magnitude at a phase $\theta_2$ of the next negative half cycle of the source voltage (see FIG. 2a) to turn the thyristor 18-1 off. At that time the element 16 has a null voltage thereacross while the source voltage $e_{uv}$ approximates the negative peak value thereof. Thus the element 16 is charged with the polarity illustrated in FIG. 1.

Now the element 16 has the relationship between a voltage v applied thereacross and a quantity of electric charge Q accumulated thereon in the form of a saturable characteristic curve such as shown in FIG. 3 wherein there is illustrated the voltage V plotted in ordinate against the quantity of electric charge Q in abscissa. In FIG. 3, $E_s$ designates a saturation voltage of the element 16.

By selecting the element 16 having such a characteristic that it enters a nonlinear region or a region having voltages in excess of the saturation voltage $E_s$ at an applied voltage not higher than the peak value of the source voltage, a charging current through the element 16 suddenly decreases at a time point where the voltage has entered the nonlinear region. Also because of the use of the inductive stabilizer 12, a voltage charged on the element 16 rapidly increases to a pulsed voltage $V_{21}$ higher than the peak value of the source voltage as shown in FIG. 2a. The pulsed voltage $V_{21}$ is applied across the fluorescent lamp 10. After the occurrence of the pulsed voltage $V_{21}$, the source voltage $e_{uv}$ is applied across the lamp 10 as shown in FIG. 2a until the thyristor 18-1 is again turned on.

The process as described above is repeated to heat the filament's 10a, 10b with the abovementioned pre-heating current and initiate the positive and negative voltages $V_{11}$ and $V_{21}$ (see FIG. 2a) respectively to discharge electrically the fluorescent lamp 10 until the latter tube is initiated to be fired.

Once the fluorescent lamp 10 has been fired, the voltage across the lamp 10 becomes less than the source voltage to disable the thyristor 18-1 to be turned on. It is noted that while the charging of the element 16 raises the lamp voltage substantially to the peak value of the source voltage as shown at voltages $V_{12}$ and $V_{22}$ in FIG. 2a, but the smoothing capacitor 18-5 is operated to prevent the thyristor 18-1 from being turned on at the voltage $V_{12}$.

Starters using the nonlinear dielectric element 16 and the reverse blocking triode thyristor 18-1 as described above have been advantageous in the good starting characteristics and a low cost due to the simple circuit configuration. However, when practically used, the circuit configuration of FIG. 1 as it is has brought the following two disadvantages:

(1) A power consumption of the fluorescent lamp increases as compared with the disconnection of the starter from a circuit with the fluorescent lamp. More specifically, when the fluorescent lamp 10 is re-fired at phases $\theta_7$ and $\theta_8$ of the next succeeding cycle of the source voltage, a charging current $i_{21}$ from an associated electric source flows into the element 16 upon the sudden rise of the lamp voltage as shown in FIG. 2b. On the contrary, when the fluorescent lamp 10 is initiated to be electrically discharged, a discharging current $i_{11}$ from the element 16 flows into the fluorescent lamp 10 as shown in FIG. 2b. That discharging current $i_{11}$ causes a fair increase in power consumption of the fluorescent lamp 10 as compared with the disconnection of the element 16 from the circuit with the fluorescent lamp 10.

(2) Due to the charging and discharging currents through the element 16 caused from the lamp voltage, as described above, an electrostrictive vibration occurs on the element 16 resulting in vibrational noise.

In order to eliminate the two disadvantages of the arrangement shown in FIG. 1 as described above, there has been already known another conventional discharge tube firing device as shown in FIG. 4. The arrangement illustrated is different from that shown in FIG. 1 only in that in FIG. 4 a semiconductor diode 20*a* is connected across the element 16 subsequently connected in series to a series combination of a discharging semiconductor diode 20*b* and a discharging resistor 22 between the filaments 10*a* and 10*b*. The serially connected diode 20*b* and resistor 22 forms a discharging circuit for the element 16. The junction of the element 16 and the diode 20*b* is connected one of the main electrodes of a bidirectional triode thyristor 18-6 substituted for the reverse blocking triode thyristor 18-1.

The operation of the arrangement shown in FIG. 4 will now be described in conjunction with both FIG. 5*a* wherein there is illustrated a waveform of the voltage across the fluorescent lamp 10 and FIG. 5*b* wherein there is illustrated a waveform of the voltage across the element 16. At the beginning of the start, the arrangement is operated in the same manner as that described above in conjunction with FIGS. 1, 2*a* and 2*b* until the thyristor 18-5 is turned off at the phase $\theta_2$ of a negative half cycle of the source voltage where the pre-heating current becomes null. Thereafter the trigger element 18-2 again turns the thyristor 18-6 on at a phase $\theta_3$ of the negative half cycle of the source voltage (see FIG. 5*s*) whereupon a charging current flows into the element 16 through the now conducting thyristor 18-6.

Since the voltage V across the element 16 is changed nonlinearly with the quantity of electric charge Q accumulated thereon, the same is charged to a voltage higher the source voltage $e_{uv}$ as described above conjunction with the arrangement of FIG. 1. That voltage is similarly applied across the fluorescent lamp 10 as a negative pulsed voltage $V_{21}$. If the charging current through the element 16 is less than a holding current of the thyristor 18-6 at a phase $\theta_4$ of the negative half cycle of the source voltage then the thyristor 18-6 is again turned off after which the source voltage is applied across the fluorescent lamp 10 up to a phase $\theta_6$ of the next succeeding positive half cycle thereof.

At the phase $\theta_6$ the thyristor 18-5 is again turned on to permit the pre-heating current flows again through the filaments 10*a* and 10*b*. Now the operation of the discharging diode and resistor 20*b* and 22 respectively will be described. The element 16 is charged at the phase $\theta_3$ (see FIG. 5*b*) and after the voltage thereacross has reached a maximum magnitude $V_{21}$ (FIG. 5*b*), the element 16 is discharged through the discharging diode and resistor 20*b* and 22 respectively with a waveform nearly approximating that of the voltage across the fluorescent lamp 10. As the voltage applied across the thyristor 18-6 is substantially equal to a difference between the voltage $V_{21}$ charging the element 16 and the source voltage $e_{uv}$, the absence of the discharging resistor results in a requirement for the thyristor 18-6 to be very high in withstanding voltage.

The purpose of the semiconductor diode 20*a* is to prevent the element 16 from charging for an angular interval between the phases $\theta_2$ and $\theta_3$ for which the thyristor 18-5 is turned off and ensure the function of providing the required a pulse at the high voltage $V_{21}$ by suddenly charging the element 16 from its null potential.

After an electric discharge thereacross, the fluorescent lamp 10 has a voltage less than the source voltage $e_{uv}$ so that the a stable discharge state is maintained without the turn-on of the thyristor 18-5. Also the voltage across the fluorescent lamp 10 is substantially applied across the thyristor 18-6 while a substantially null voltage is applied across the element 16. This results in the elimination of the disadvantages of the arrangement as shown in FIG. 1 caused from the charging and discharging currents through the elements 16 as described above. However due to the presence of the diode 20*a* connected across the element 16, the element 16 is not applied with any voltage in the positive direction for a time interval of generation of the pulsed voltages as shown at waveform in FIG. 5*b*.

In the resulting unidirectional electric field the element 16 is subjected to the dielectric polarization inclined toward one side. Therefore the square hysteresis loop shown FIG. 3 gets out of its shape which loses the nonlinear characteristics. This has resulted in the disadvantages that the negative pulsed voltage $V_{21}$ developed at the phase $\theta_4$ across the element 16 much decreases in amplitude to make it difficult to start the fluorescent lamp 10.

FIG. 6 shows still another conventional discharge tube firing device for eliminating the disadvantage of the arrangement shown in FIG. 4 as described above. The arrangement illustrated is different from that shown in FIG. 4 only in that in FIG. 6 a diode thyristor 24 is serially connected to the semiconductor diode 20*a* across the element 16. The diode thyristor may comprise a PNPN switch, a silicon symmetrical switch which is abbreviated to an ("SSS") or the like and forms another semiconductor switch.

The arrangement of FIG. 6 is operated in the same manner as that shown in FIG. 1 except for the following respects; referring to FIGS. 7*a* and 7*b* wherein there are illustrated waveforms of voltages across the fluorescent lamp 10 and the element 16 respectively, the semiconductor switch 18 or the bidirectional triode thyristor 18-6 is turned on at the phase $\theta_1$ of the positive half cycle of the source voltage with a current flowing through a current path traced from the source terminal U through the stabilizer 12, the filament 10*a*, the element 16, the bidirectional triode thyristor 18-6, the filament 10*b* and thence to the source terminal V. After this turn-on of the thyristor 18-6, a voltage approximating the source voltage is applied across the semiconductor switch 24 through the diode 24*a* and also across the element 16 as a positive voltage $V_{13}$ (see FIG. 7*b*) to ensure that the square hysteresis curve for the element 16 is maintained. Therefore a negative pulse pulsed high voltage $V_{21}$ is normally developed across each of the fluorescent lamp 10 and the element 16 as shown in FIGS. 7*a* and 7*b*.

Figure 5A:
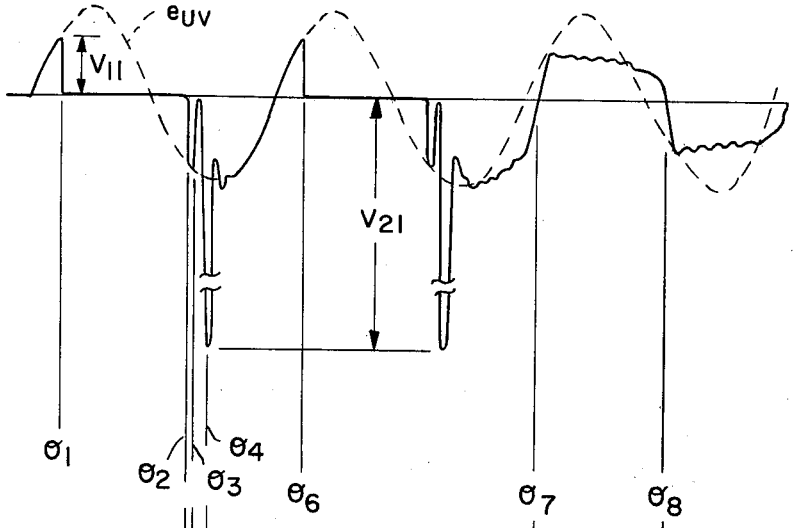
FIG. 5*a* is a graph illustrating a waveform of a voltage across the fluorescent lamp shown in FIG. 4.
Figure 5B:
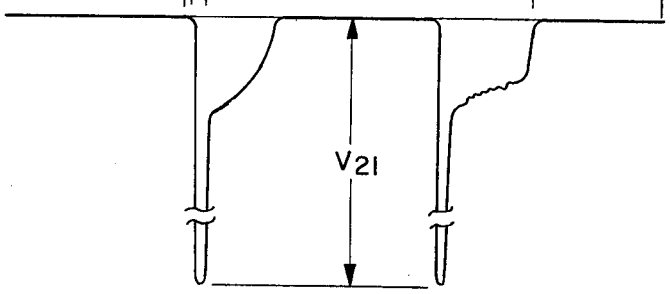
FIG. 5*b* is a graph illustrating a waveform of a voltage across the nonlinear dielectric element shown in FIG. 4.

When the semiconductor switch 24 is applied with the voltage substantially approximating the source voltage, the same is turned on at a phase $\theta_1'$ of the source voltage (see FIG. 5*a*). At that time the pre-heating current is permitted to flow through a current path traced from the source terminal U, the stabilier 12, the filament 10*a*, the diode thyristor or the semiconductor switch 24, the bidirectional triode thyristor 18-5, the filament 10*b* and thence to the source terminal V to heat the filaments 10*a* and 10*b*. After the fluorescent lamp 10 has been subsequently fired, the element is applied with a undirectional voltage at and after a phase $\theta_7$ of the source voltage (see FIG. 7*a*).

This results the elimination of the disadvantages of the arrangements shown in FIGS. 1 and 4. That is, the arrangement of FIG. 6 can eliminate the disadvantage due to flows of charging and discharging currents through the element 16 shown in FIG. 1 and a decrease in pulsed high voltage $V_{21}$ due to the absence of the positive voltage applied across the element 16 shown in FIG. 4. However, the phase $\theta_1$ at which the bidirectional triode thyristor 18-6 is turned on lags behind the phase $\theta_1$ at which the preheating current is initiated to flow through the filaments 10*a* and 10*b*. Thus the filaments 10*a* and 10*b* are insufficiently heated resulting in the new disadvantage that the fluorescent lamp 10 is difficult to be fired.

The present invention contemplates to eliminate the disadvantages of the arrangements such as shown in FIGS. 1, 4 and 6 at a stroke. In other words, the present invention can eliminate the disadvantages that (1) the charging and discharging currents flow through the element 14 to increase an electric power consumed by the fluorescent lamp 10 and generate vibrational noise, (2) the elemtn 14 decreases in negative pulsed voltage $V_{21}$ applied thereto and (3) the pre-heating current is insufficient to render the firing of the fluorescent lamp 10 difficult.

Referring now to FIG. 8, there is illustrated one embodiment according to the discharge tube firing device of the present invention. The arrangement illustrated is different from that shown in FIG. 1 only in that in FIG. 8, a semiconductor switch 24 is serially connected to the element 16 across the semiconductor switch 18 to form a charging circuit for the element 16 and further connected across a discharging circuit 26 for the element 16. The semiconductor switch 24 may formed of a diode thyristor such as a PNPN switch, an SSS or the like as in the arrangement shown in FIG. 6. The discharging circuit 26 includes a discharging resistor 22. For explanation purposes, the semiconductor switch 18 is hereinafter called the first semiconductor switch and the semiconductor switch 24 is hereinafter called the second semiconductor switch.

The operation of the arrangement shown in FIG. 8 will now be described in conjunction with FIGS. 9*a* and 9*b* wherein there are illustrated waveforms of voltages across the fluorescent lamp 10 and the element 16 respectively. As described above in conjunction with the arrangement of FIG. 1, the reverse blocking triode thyristor 18-1 is turned on at the phase $\theta_1$ of the positive half cycle of the source voltage $e_{uv}$ at the beginning of the start. This results in a pre-heating current flowing through the current path traced from the source terminal U through the stabilizer 12, the filament 10*a*, the now conducting thyristor 18-1, the filament 10*b* and thence to the source terminal V. Then the thyristor 18-1 is turned off at the phase $\theta_2$ of the next succeeding negative half cycle of the source voltage $e_{uv}$ at which the pre-heating current has a null magnitude. This turn-off of the thyristor 18-1 causes the negative source voltage to be applied across the fluorescent lamp 10. That negative source voltage is divided into voltage portions sharped on the element 16 and the discharging resistor 22 respectively. By selecting the magnitude of resistance 22 so as to turn the second semiconductor switch 24 (which is called hereinafter a "diode thyristor") on with that portion of the voltage applied across the resistor 22, the diode thyristor 24 is turned on at the phase $\theta_3$ of the source voltage as shown in FIG. 9*a*. Thus a charging current flows into the element 16.

Since the element 16 has the nolinear characteristic such as shown in FIG. 3, the same is charged to a voltage higher than the source voltage $e_{uv}$ as described above in conjunction with the arrangement of FIG. 1. Therefore the charged voltage on the element 16 is applied, as a negative pulsed voltage $V_{21}$, across the fluorescent lamp 10 (see FIG. 9*a*).

If the charging current through the element 16 is less than a holding current for the diode thyristor 24 at the phase $\theta_4$ of the source voltage, that thyristor is turned off. Thereafter the source voltage $e_{uv}$ is applied across the fluorescent lamp 10 until the thyristor 18-1 is again turned on. Then the process as described above continues until the discharge tube 10 is fired.

Once the fluorescent lamp 10 has been fired, the voltage thereacross becomes smaller than the source voltage so that the thyristor 18-1 and 24 are disabled to be fired while the fluorescent 10 continues to be put in stable lighting state without the occurrence of the pulsed voltage $V_{21}$.

Voltages developed on the arrangement of FIG. 8 upon the occurrence of the pulsed voltage across the element 14 and the firing of the fluorescent lamp 10 will now be described with reference to FIG. 9*b*. Upon the occurrence of the pulsed voltage for an angular interval between the phases $\theta_5$ and $\theta_6$ of the source voltage $e_{uv}$, the fluorescent lamp 10 is applied with the source voltage while the element 16 is applied with that portion of the source voltage divided by the element 16 and the resistor 22 and applied across the latter. Accordingly, by properly selecting the magnitude of resistance 22, the element 16 can be applied with a positive voltage amounting at its maximum magnitude $V_{13}$ in the positive half cycle of the source voltage.

It is recalled that, after the firing of the fluorescent lamp 10 in the arrangement shown in FIG. 1, the charging and discharging currents through the element 16 render the rise and fall of the voltage across the fluorescent lamp 10 steep as shown at $V_{12}$ and $V_{22}$ in FIG. 2*a*. In the arrangement of FIG. 8, however, the voltage developed across the element 16 has its rise and fall rendered very slow as shown at waveforms labelled $V_{14}$ and $V_{23}$ in FIG. 9*b*. This attributes to the damping action of the discharging resistor 22. In other words, the resistor 22 reduces much the problems that the charging and discharging currents through the element 16 increase the electric power consumed by the fluorescent lamp 10 and generate an electrostrictive vibration and therefore vibrational noise with the result that such noise decrease to a level practically giving no obstruction.

Also the arrangement of FIG. 8 is arranged to apply also the positive voltage across the element 16 thereby to eliminate the disadvantage that the pulsed voltage $V_{21}$ decreases due to the absence of this a positive voltage as described above in conjunction with the arrangement of FIG. 4. In addition, the arrangement of FIG. 8 can prevent the pre-heating current from being insufficient to heat the filaments 10*a* and 10*b*.

While the present invention has been illustrated and discribed in conjunction with the second semiconductor switch 24 formed of the diode thyristor it is to be understood that it is not restricted thereto or thereby. If desired, the second semiconductor switch may be formed of a triode thyristor such as a semiconductor controlled rectifier abbreviated to an "SCR" or a triac (trade mark). In the latter case, the voltage across the fluorescent lamp 10 is used as a gate voltage for the triode thyristor.

Figure 10:
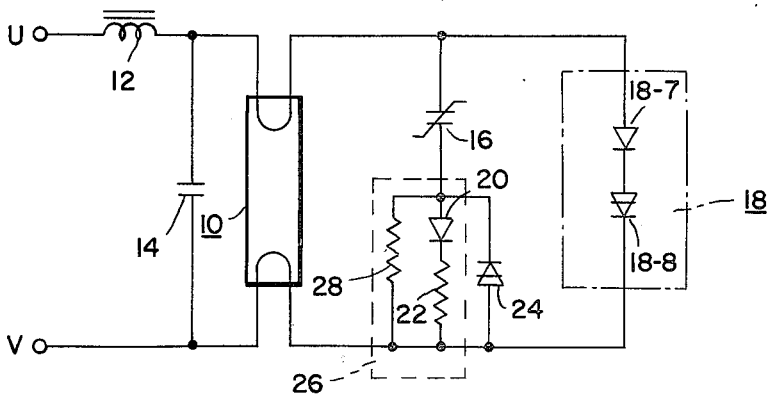
FIG. 10 is a diagram similar to FIG. 8 but illustrating a modification of the present invention.

FIG. 10 shows a modification of the present invention. The arrangement illustrated is different from that shown in FIG. 8 only in that in FIG. 10 the first semiconductor switch 18 includes only a series combination of a semiconductor diode 18-7 and a diode thyristor 18-8 and the discharging circuit 26 includes a resistor 28 connected across a series combination of a semiconductor diode 20 and the resistor 22 which is shown in FIG. 8.

The purpose of the diode 18-7 is to block the negative pulsed high voltage $V_{21}$ applied across the triode thyristor 18-8. Also with the diode thyristor 18-8 disposed in the first semiconductor switch 18, it is required to render a breakover voltage $V_{BO}$ thereof less than the peak value $V_{15}$ of the source voltage and higher than the peak value $V_{12}$ of the voltage across the fluorescent lamp 10. That is, the breakover voltage $V_{BO}$ should lie between $V_{12}$ and $V_{15}$ shown in FIG 11*a* wherein there is also illustrated a waveform of a voltage across the fluorescent lamp 10 in the arrangement of FIG. 10. In other words, $V_{12}<V_{BO}<V_{15}$ should hold.

At the phase $\theta_3$ of the source voltage the diode thyristor 24 has applied thereacross that portion of the source voltage divided by the element 16 and the resistor 22 and applied across the latter. Thus the diode thyristor 24 has its breakover voltage $V_{BO}$ required to be set to be fairly less than the peak value $V_{15}$ of the source voltage.

In the arrangement of FIG. 10, however, a voltage applied across the diode thyristor 24 at the $\theta_3$ of the source voltage may be equal to at most twice the peak value $V_{15}$ of the source voltage by the action of the diode 20. As that voltage may be selected at will by properly setting the magnitude of the resistor 28, the diode thyristor 18-8 acting as the first semiconductor switch 18 is possible to be identical in specifications or breakover voltage to the diode thyristor 24 serially connected to the element 16. This is, the purpose of the arrangement shown in FIG. 10 is to use the diode thyristor 18-7 and 24 identical in specifications to each other. Accordingly the arrangement of FIG. 10 is advantageous in view of the manufacturing. A capacitor may be substituted for the resistor 28 with the satisfactory result.

Figure 11A:
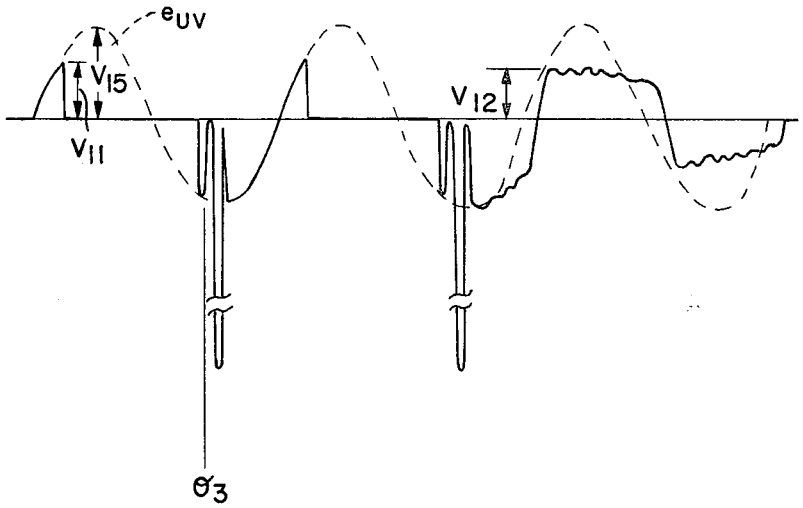
FIG. 11a is a graph illustrating a waveform of a voltage across the fluorescent lamp shown in FIG. 10.
Figure 11B:
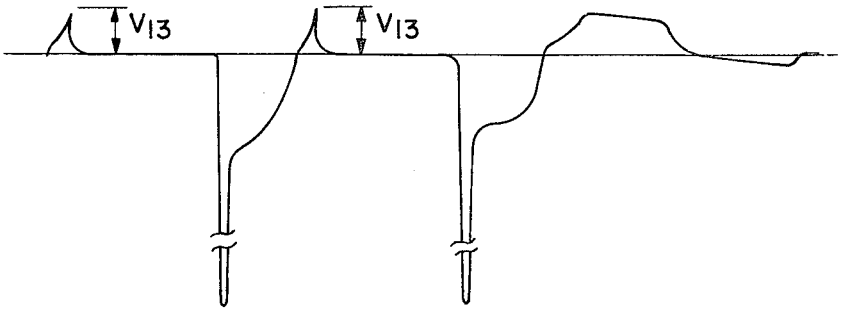
FIG. 11b is a graph illustrating a waveform of a voltage across the nonlinear dielectric element shown in FIG. 10.

As shown in FIG. 11*b* wherein there is illustrated a waveform of a voltage across the element 16 shown in FIG. 10, the positive voltage $V_{13}$ is applied across the element 16 upon the occurrence of the pulsed high voltage as in the arrangement of FIG. 8 and after the firing of the fluorescent lamp 10, the element 16 is similarly applied with a positive voltage in the substantially positive half cycle of the source voltage. At that time, the resistors 22 and 28 perform the damping function of reducing the charging and discharging currents through the element 16 to their levels practically giving no abstruction as in the arrangement of FIG. 8.

Figure 12:
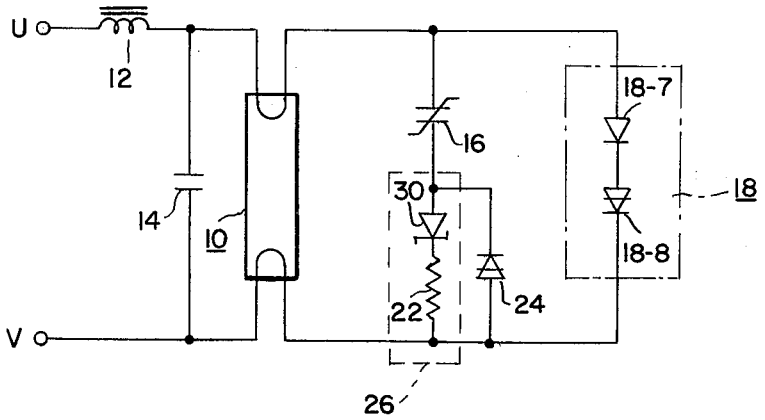
FIG. 12 is a diagram similar to FIG. 10 but illustrating another modification of the present invention.

FIG. 12 shows still another modification of the present invention. The arrangement illustrated is different from that shown in FIG. 10 only in that in FIG. 12, a Zener diode 30 is substituted for the diode 20*b* with the resistor 28 omitted.

Figure 13:
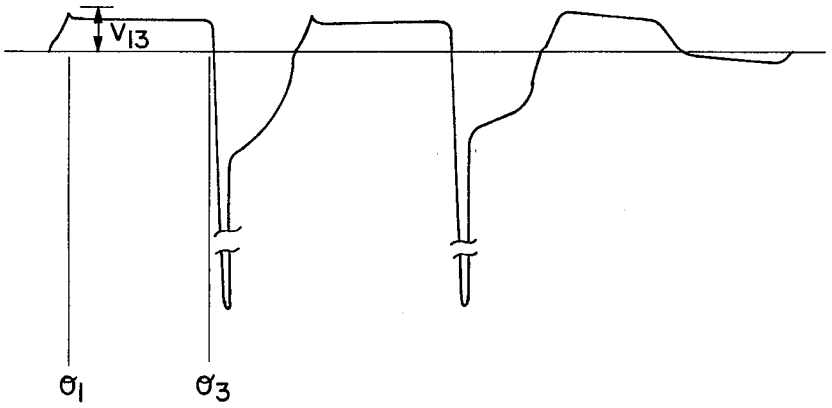
FIG. 13 is a graph illustrating a waveform of a voltage across the nonlinear dielectric element shown in FIG. 12.

The fluorescent lamp 10 has applied thereacross a voltage waveform substantially as shown in FIG. 11*a* and the element 16 has applied thereacross a voltage waveform substantially as shown in FIG. 13.

By setting a Zener voltage $V_Z$ of the Zener diode 30 to not less than the peak value $V_{15}$ of the source voltage, twice the peak value $V_{15}$ of the source voltage is applied across the diode thyristor 24 at the phase $\theta_3$ of the source voltage. On the contrary, if the Zener voltage $V_Z$ is set to less than the peak value $V_{15}$ then the voltage across the diode thyristor 24 can be selected at will to be of a magnitude less than twice the peak source voltage $V_{15}$. This means that it is possible to use the diode thyristors 18-7 and 24 identical in characteristics to each other as in the arrangement of FIG. 10.

As shown in FIG. 13, the positive voltage $V_{13}$ is applied across the element 14 upon the occurrence of the pulsed high voltage as in the arrangement of FIG. 8 but the Zener diode 30 is operated so that the positive voltage $V_{13}$ remain unchanged up to the phase $\theta_3$ of the source voltage at which the diode thyristor 24 is turned on. Thus the element 16 is charged from the positive voltage and therefore the negative pulse voltage $V_{21}$ developed therein is high as compared with the arrangements shown in FIGS. 8 and 10.

After the firing of the fluorescent lamp 10, the arrangement of FIG. 12 is operated in the similar manner as described above in conjunction with the arrangements shown in FIGS. 8 and 10 to reduce the charging and discharging currents through the element 16 to their levels practically giving no abstruction.

The arrangement of FIG. 12 is advantageous in that, in addition to the advantage in view of the manufacturing as described above in conjunction with that shown in FIG. 10, the number of the component decreases and the power consumption of the fluorescent lamp 10 reduces during the lighting thereof because the resistor 22 has been omitted.

In order to demonstrate the excellencies of the present invention over the prior art practice, firing devices for the 40 watt fluorescent lamp Type FL-40 have been constructed according to the conventional arrangements shown in FIGS. 1, 4 and 6 and the embodiments of the present invention shown in FIGS. 8, 10 and 12 respectively. The firing devices included, as common components, the element 16 formed of a barium titanate capacitor having an electrode area of 230 square millimeters, a saturation voltage of 50 volts and a dielectric 0.45 millimeter thick, the stabilizer 12 of the inductive type and the noise preventing capacitor 14 having a capacitance of 7,000 picofarads, and further respective components as specified in the undermentioned Table 1.

The devices were operated with the source voltage $e_{uv}$ of 200 volts at 50 hertz to fire 40 watts fluorescent lamps FL-40 respectively and the pulsed voltage $V_{21}$, the power consumption of the fluorescent lamp 10, the positive voltage $V_{13}$, the electrostictive vibration and the starting characteristics were measured. When the starter was disconnected therefrom, the fluorescent lamp 10 consumed an electric power WL of 38.5 watts in each of the firing devices. The results of the measurements are listed in Table I.

TABLE I

Comparison of the Present Invention with the Prior Art

| | Specifications of Components | Pulsed Voltage in V | Power Consump. of Fluor. Lamp in W | Pos. Voltage in V | Electrostr. Vibr. | Start Char. |
|---|---|---|---|---|---|---|
| Prior Art I | Rev. Block, Triode Thyristor 18-1: SCR 2A 1200V | 1100 | 48 | 200 | Large | Good |

TABLE I-continued

Comparison of the Present Invention with the Prior Art

| | Specifications of Components | Pulsed Voltage in V | Power Consump. of Fluor. Lamp in W | Pos. Voltage in V | Electrostr. Vibr. | Start Char. |
|---|---|---|---|---|---|---|
| FIG. 1 | Trigger El. 18-2: SBS Volt 8V<br>Volt Div. Gate Res. 18-3: 330KΩ<br>Volt Div. Gate Res. 18-4: 15KΩ<br>Smooth Cap. 18.5: 0.1μF | | | | | |
| Prior Art II FIG. 3 | Bidir. Triode<br>Thyristor 18-6:Triac C 3A 600V<br>Dischg. Res. 22: 10KΩ<br>Diode 20a: 1200V 1A<br>Diode 20b: 400V 1A<br>Other Comps. Ident. to those in Prior Art I | 550 | 38.6 | 0 | Small | Poor |
| Prior Art III FIG. 6 | Diode Thyristor 24: PNPN SW : $V_{BO}$ = 250V<br>Other Comps. Ident. to those in Prior Art I | 1100 | 38.6 | 250 | Small | Poor |
| Pres. Inv. I FIG. 8 | Dischg. Res. 22: 10KΩ<br>Diode Thyristor 24: PNPN SW : $V_{BO}$ = 210V<br>Other Comps. Ident. to those in Prior Art I | 1050 | 38.3 | 40 | Small | Good |
| Pres. Inv. II FIG. 10 | Diode Thyristor 18-7: PNPN SW<br>Diode 18-6: 1A 1200V<br>Dischg. Res. 22: 10KΩ<br>Diode 20: 1A 400V<br>Diode Thyristor 24: PNPN SW : $V_{BO}$ = 250V<br>Res. 28: 33KΩ | 1050 | 38.7 | 40 | Small | Good |
| Pres. Inv. III FIG. 12 | Diode Thyristor 18-7: PNPN SW : $V_{BO}$ =250V<br>Diode 18-6: 1A 1200V<br>Dischg. Res. 22: 10KΩ<br>Zener Diode 30: $V_Z$ = 100V | 1100 | 38.7 | 40 | Small | Good |

From Table I it is seen that the present invention is excellent in pulsed voltage $V_{21}$, positive voltage $V_{13}$, power consumption of the fluorescent lamp, electrostrictive vibration, and starting characteristics as compared with the prior art practice.

In summary, the present invention provides a device for firing a discharge tube connected to an inductive stabilizer by a first semiconductor switch and a nonlinear dielectric element wherein the nonlinear dielectric element has serially connected thereto a second semiconductor switch forming a charging circuit for the nonlinear dielectric element and the second semiconductor switch is connected across a discharging circuit for the nonlinear dielectric element. Therefore the present invention decrease a power consumption of an associated fluorescent lamp, and reduces noise due to the nonlinear dielectric element while improving the starting characteristics of the fluorescent lamp. In other words the present invention improves all the disadvantages of the prior art practice as described above.

While the present invention has been illustrated and described in conjunction with a few preferred embodiments thereof it is to be understood that numerous changes and modification may be resorted to without departing from the spirit and scope of the present invention. For example while the present invention has been described in conjunction with the fluorescent lamp it is to be understood the same is equally applicable a variety of discharge tubes other than the fluorescent lamp.

What is claimed is:

1. A discharge tube firing device comprising: a discharge tube; an inductive stabilizer connected in series with said discharge tube; a first semiconductor switch and a nonlinear dielectric element each connected in parallel to said discharge tube; a second semiconductor switch connected in series with said nonlinear dielectric element and in parallel to said first semiconductor switch, said second semiconductor switch serving as a charging circuit for said nonlinear dielectric element; and a discharging circuit connected in parallel to said second semiconductor switch.

2. A discharge tube firing device as claimed in claim 1, wherein said discharging circuit comprises a resistor.

3. A discharge tube firing device as claimed in claim 1, wherein said discharging circuit comprises: a resistor; a semiconductor diode connected in series with said resistor; and an impedance element connected in parallel to said series combination of said resistor and said semiconductor diode.

4. A discharge tube firing device as claimed in claim 1, wherein said discharging circuit comprises a resistor and a Zener diode connected in series with said resistor.

5. A discharge tube firing device comprising:

a discharge tube;

an inductive stabilizer connected in series with said discharge tube;

a first semiconductor switch and a nonlinear dielectric element each connected in parallel to said discharge tube;

a second semiconductor switch comprising a thyristor connected in series with said nonlinear dielectric element and in parallel to said first semiconductor switch, said second semiconductor switch serving as a charging circuit for said nonlinear dielectric element;

and a discharging circuit connected in parallel to said second semiconductor switch.

6. A discharge tube firing device as claimed in claim 5, wherein said discharging circuit comprises a resistor.

* * * * *